United States Patent [19]

Sekine et al.

[11] Patent Number: 5,036,039

[45] Date of Patent: Jul. 30, 1991

[54] HEAT-SENSITIVE RECORDING MATERIAL

[75] Inventors: Mikiya Sekine, Warabi; Shigetoshi Hiraishi, Tokyo, both of Japan

[73] Assignee: Mitsubishi Paper Mills Limited, Tokyo, Japan

[21] Appl. No.: 565,238

[22] Filed: Aug. 10, 1990

[30] Foreign Application Priority Data

Nov. 14, 1989 [JP] Japan ..... 1-296349

[51] Int. Cl.[5] ..... B41M 5/30

[52] U.S. Cl. ..... 503/217; 427/150; 503/208; 503/209; 503/225

[58] Field of Search ..... 503/208, 209, 216–218, 503/225; 427/150–152

[56] References Cited

U.S. PATENT DOCUMENTS 4,824,824 4/1989 Matsushita et al. ..... 503/204

*Primary Examiner*—Bruce H. Hess

*Attorney, Agent, or Firm*—Cushman, Darby & Cushman

[57] ABSTRACT

Disclosed is a heat-sensitive recording material comprising an aromatic isocyanate compound, an imino compound which reacts with said aromatic isocyanate compound upon application of heat to form color, and a support, wherein a coating color comprising a dispersion obtained by pulverizing a mixture of said aromatic isocyanate compound and an alcoholic compound has been coated on the support. This heat-sensitive recording material is excellent in image stability and sensitivity.

7 Claims, No Drawings

HEAT-SENSITIVE RECORDING MATERIAL

The present invention relates to a heat-sensitive recording material excellent in image storage stability and sensitivity which comprises a support and, provided thereon, a specific heat-sensitive recording layer.

Generally, heat-sensitive recording materials comprise a support and, provided thereon, a heat-sensitive recording layer mainly composed of an election-donating, colorless dye precursor and an electron-accepting developer and upon application of heat thereto by thermal head, hot pen, laser beam, and the like, the colorless dye precursor instantaneously reacts with the developer to form recorded images as disclosed in Japanese Patent Kokoku (Post Exam. Publication) Nos 43-4160 and 45-14039.

These heat-sensitive recording materials have merits in that recording can be attained by relatively simple devices and thus maintenance is easy and no noise is generated and they are widely utilized in various fields such as recorders for instruments, facsimile, printer, terminals of computer, labeling, and ticket vending machine.

Heat-sensitive recording materials which use such electron-donating, colorless dye precursor and electron-accepting developer have excellent characteristics that they have good appearance and touch and they can give high color density and various color shades, but they have defects in storage stability of recorded image in that heat-sensitive color formed portion (recorded image portion) when allowed to contact with plastics such as polyvinyl chloride disappears due to plasticizer or additives contained in the plastics or when allowed to contact with chemicals contained in foods or cosmetics readily disappears or readily discolors due to sunlight exposure of a short period. These defects impose limitation in use and improvement of these defects has been strongly demanded.

Furthermore, high-speed printing machines which make it possible to print in a short time have been developed and accordingly, heat-sensitive recording materials of high sensitivity which are excellent in heat responsiveness and can give sufficient color images even with low energy have been required.

As heat-sensitive recording materials which can afford recorded images of high storage stability by reaction of two components upon heating, there have been proposed those which contain an imino compound and an isocyanate compound as the two components in Japanese Patent Kokai (Laid-Open) Nos. 58-38733, 58-54085, 58-104959, 58-149388, 59-115887, and 59-115888 and U.S. Pat. No. 4,521,793.

Although superior in storage stability of recorded images, these heat-sensitive recording materials are insufficient in sensitivity (heat responsiveness) and cannot produce recorded image of sufficient density by high-speed printing apparatuses.

As a result of intensive research conducted by the inventors in an attempt to obtain heat sensitive recording materials of high sensitivity which are excellent in image storage stability and high in heat responsiveness, the object has been attained by providing a heat-sensitive recording material comprising an aromatic isocyanate compound, an imino compound which reacts with said aromatic isocyanate compound upon application of heat to form color, and a support, wherein a coating color comprising a dispersion obtained by pulverizing a mixture of said aromatic isocyanate compound and an alcoholic compound coated on the support.

The alcoholic compound used in the present invention includes mono- or polyhydric lower and higher aliphatic alcohols, alicyclic alcohols and aromatic alcohols. As examples of these compounds, mention may be made of methyl alcohol, ethyl alcohol, propyl alcohol, isopropyl alcohol, butyl alcohol, isobutyl alcohol, sec-butyl alcohol, tert-butyl alcohol, amyl alcohol, isoamyl alcohol, sec-amyl alcohol, tert-amyl alcohol, 3-methoxybutyl alcohol, hexyl alcohol, 2-methyl-1-pentanol, sec-hexyl alcohol, 2-ethylbutyl alcohol, sec-heptyl alcohol, 3-heptanol, octyl alcohol, 2-ethylhexyl alcohol, sec-octyl alcohol, nonyl alcohol, 2,6-dimethyl-4-heptanol, decanol, sec-undecyl alcohol, trimethylnonyl alcohol, sec-tetradecyl alcohol, sec-heptadecyl alcohol, lauryl alcohol, stearyl alcohol, cyclohexanol, methylcyclohexanol, 3,3,5-trimethylcyclohexanol, cyclododecanol, allyl alcohol, benzyl alcohol, phenylmethyl carbinol, veratryl alcohol, piperonyl alcohol, 1,1-diphenylethanol, ethylene glycol, 1,2-propylene glycol, 1,3-butylene glycol, 2,3-butylene glycol, hexylene glycol, 2,4-pentanediol, 2,5-hexanediol, 2,4-heptanediol, 2-ethyl-1,3-hexanediol, diethylene glycol, dipropylene glycol, triethylene glycol, tripropylene glycol, trimethylolethane, glycerin, trimethylolmethane, trimethylolpropane, 1,4-cyclohexanediol, 1,2-cyclohexanediol, 1,2,4-butanetriol, pentaerythritol, sorbitol, 1,2-benzene dimethanol, 1,4-benzene dimethanol, p-xylene glycol, and styrene glycol. Especially preferred are those which are liquid at room temperature or have compatibility with water.

When a dispersion obtained by pulverizing simultaneously the above alcoholic compound and an aromatic isocyanate compound which is one of color forming components is used, sensitivity is much improved as compared with when an aromatic isocyanate compound alone is pulverized and is used. It is considered that this is because hydroxyl group of the alcoholic compound reacts with isocyanate group on the surface of fine particles of aromatic isocyanate compound to form a kind of hydrophobic quasi-capsule layer on the surface of fine particles, which inhibits deactivation of isocyanate group caused by reaction of water which is a dispersion medium with the isocyanate group, which is a cause for reduction of sensitivity.

The inventors have also made examination on compounds containing amino group which reacts with isocyanate group and as a result it has been found that many of them are high in reactivity and isocyanate group reacts with amino group during pulverization or storage of dispersion after pulverization to cause deactivation of active isocyanate group. Furthermore, the compounds containing amino group generally have the disadvantage of tending to cause discoloration upon irradiation with light.

The alcoholic compound is used in an amount of 1–300% by weight, preferably 5–50% by weight based on the weight of the aromatic isocyanate compound. If amount of alcoholic compound is less than 1% by weight, the surface of fine particles cannot be completely covered with the quasi-capsule layer and hence, isocyanate group reacts with water to be deactivated and thus sensitivity of heat-sensitive recording material decreases. Furthermore, since aromatic isocyanate compound is dissolved in alcoholic compound, fogging occurs in background when addition amount of the alcoholic compound is too large. This is practically not desired.

The aromatic isocyanate compound used in the present invention includes aromatic isocyanate compound or heterocyclic isocyanate compounds which are solid at room temperature and are colorless or palely colored. For example, one or more of the following isocyanate compounds are used.

2,6-Dichlorophenyl isocyanate, p-chlorophenyl isocyanate, 1,3-phenylene diisocyanate, 1,4-phenylene diisocyanate, 1,3-dimethylbenzene-4,6-diisocyanate, 1,4-dimethylbenzene-2,5-diisocyanate, 1-methoxybenzene-2,4-diisocyanate 1-methoxybenzene-2,5-diisocyanate, 1-ethoxybenzene-2,4-diisocyanate, 2,5-dimethoxybenzene-1,4-diisocyanate, 2,5-diethoxybenzene-1,4-diisocyanate, 2,5-dibutoxybenzene-1,4-diisocyanate, azobenzene-4,4'-diisocyanate, diphenyl ether-4,4'-diisocyanate, naphthalene-1,4-diisocyanate, naphthalene-1,5-diisocyanate, naphthalene-2,6-diisocyanate, naphthalene-2,7-diisocyanate, 3,3'-dimethyl-biphenyl-4,4'-diisocyanate, 3,3'-dimethoxybiphenyl-4,4'-diisocyanate, diphenyl-methane-4,4'-diisocyanate, benzophenone-3,3'-diisocyanate, fluorene-2,7-diisocyanate, anthraquinone-2,6-diisocyanate, 9-ethylcarbazole-2,6-diisocyanate, pyrene-3,8-diisocyanate, naphthalene-1,3,7-triisocyanate, biphenyl-2,4,4'-triisocyanate, 4,4',4''-triisocyanate-2,5-dimethoxytriphenylamine, p-dimethylaminophenyl isocyanate, and tris(4-phenylisocyanate) thiophosphate. If necessary, these isocyanate compounds may be used in the form of so-called block isocyanates which are addition compounds with phenols, lactams or oximes or in the form of isocyanurates which are dimers of diisocyanates, for example, dimers and trimers of 1-methyl-benzene-2,4-diisocyanate. However, when isocyanate groups are all blocked, the effect of the present invention may not be exhibited in some case.

One or more of these aromatic isocyanate compounds and one or more of these alcoholic compounds are previously predispersed in an aqueous solution containing compound having dispersibility such as water-soluble polymer, polymer emulsion or surface active agent and this pre-dispersion is milled to average particle size of 0.2–5.0 μm, preferably 0.7–3.0 μm by dispersing machine such as ball mill, sand mill, dyno mill, attritor, or colloid mill to prepare a dispersion.

The imino compounds used in the present invention are those which have at least one >C=NH and are represented by the formula $$\phi \quad C{=}NH$$

($\phi$ is an aromatic compound residue capable of forming conjugated system with C=N) and are solid at room temperature and colorless or light-colored compounds. Examples of them are shown below. Two or more of these imino compounds may also be used in combination for some purposes.

3-Iminoindolin-1-one, 3-imino-4,5,6,7-tetrachloroisoindolin-1-one, 3-imino-4,5,6,7-tetrabromoisoindolin-1-one, 3-imino-4,5,6,7-tetrafluoroisoindolin-1-one, 3-imino-5,6-dichloroisoindolin-1-one, 3-imino-4,5,7-trichloro-6-methoxy-isoindolin-1-one, 3-imino-4,5,7-trichloro-6-methylmercapto-isoindolin-1-one, 3-imino-6-nitroisoindolin-1-one, 3-imino-isoindolin-1-spiro-dioxolan, 1,1-dimethoxy-3-imino-isoindoline, 1,1-diethoxy-3-imino-4,5,6,7-tetrachloroisoindoline, 1-ethoxy-3-iminoisoindoline, 1,3-diiminoisoindoline, 1,3-diimino-4,5,6,7-tetrachloroisoindoline, 1,3-diimino-6methoxyisoindoline, 1,3-diiimino-6-cyanoindoline, 1,3-diimino-4,7-dithia-5,5,6,6-tetrahydroisoindoline, 7-amino-2,3-dimethyl-5-oxopyrrolo[3,4b]pyrazine, 7-amino-2,3-diphenyl-5-oxopyrrolo[3,4b]pyrazine, 1-imino-naphthalic acid imide, 1-iminodiphenic acid imide, 1 -phenylimino-3-iminoisoindoline, 1-(3'-chlorophenyl-imino)-3-iminoisoindoline, 1-(2',5'-dichlorophenyl-imino)-3-iminoisoindoline, 1-(2',4',5'-trichlorophenyl-imino)-3-iminoisoindoline, 1-(2'-cyano-4'-nitrophenyl-imino)-3-iminoindoline, 1-(2'-chloro-5'-cyanophenyl-imino)-3-iminoisoindoline, 1-(2',6'-dichloro-4'-nitrophenylimino)-3-iminoisoindoline, 1-(2',5'-dimethoxyphenylimino)-3-iminoisoindoline, 1-(2',5'-diethoxyphenylimino)-3-iminoisoindoline, 1-(2'-methyl-4'-nitrophenylimino)-3-iminoisoindoline, 1-(5'-chloro-2'-phenoxyphenylimino)-3-iminoisoindoline, 1-(4'-N,N-dimethylaminophenylimino)-3-iminoisoindoline, 1-(3'-N,N-dimethylamino-4'-methoxyphenylimino)-3-iminoisoindoline, 1-(2'-methoxy-5'-N-phenylcarbamoylphenylimino)-3-iminoisoindoline, 1-(2'-chloro-5'-trifluoromethylphenylimino)-3-iminoisoindoline, 1-(5',6'-dichlorobenzothiazolyl-2'-imino)-3-iminoisoindoline, 1-(6'-methylbenzothiazolyl-2'-imino)-3-iminoisoindoline, 1(4'-phenylaminophenylimino)-3-iminoisoindoline, 1-(p-phenylazophenylimino)-3-iminoisoindoline, 1-(naphthyl-1'-imino)-3-iminoisoindoline, 1-(anthraquinone-1'-imino)-3-iminoisoindoline, 1-(5'-chloroanthraquinone-1'-imino)-3-iminoisoindoline, 1-(N-ethylcarbazolyl-3'-imino)-3-iminoisoindoline, 1-(naphthoquinone-1'-imino)-3-iminoisoindoline, 1-(pyridyl-4'-imino)-3-iminoisoindoline, 1-(benzimidazolon-6'-imino)-3-iminoisoindoline, 1-(1'-methylbenzimidazolone-6'-imino)-3-iminoisoindoline, 1-(7'-chlorobenzimidazolone-5'-imino)-3-iminoisoindoline, 1-(benzimidazolyl-2'-imino)-3iminoisoindoline, 1-(benzimidazolyl-2'-imino)-3-imino-4,5,6,7-tetrachloroisoindoline, 1-(2',4'-dinitrophenylhydrazone)-3-iminoisoindoline, 1-(indazolyl-3'-imino)-3-iminoisoindoline, 1-(indazolyl-3'-imino)-3-imino-4,5,6,7-tetrabromoisoindoline, 1-(indazolyl-3'-imino)-3-imino-4,5,6,7-tetrafluoroisoindoline, 1-(benzimidazolyl-2'-imino)-3-imino-4,5-dithiatetrahydroisoindoline, 1-(4',5'-dicyanoimidazolyl-2'-imino)-3-imino-5,6-dimethyl-4,7-pyradiisoindoline, 1-(cyanobenzoylmethylene)-3-iminoisoindoline, 1-(cyanocarbonamidomethylene)-3-iminoisoindoline, 1-(cyanocarbomethoxymethylene)-3-iminoisoindoline, 1-(cyanocarboethoxymethylene)-3-iminoisoindoline, 1-(cyano-N-phenylcarbamoylmethylene)-3-iminoisoindoline, 1-[cyano-N-(3'-methylphenyl)carbamoylmethylene]-3-iminoisoindoline, 1-[cyano-N-(4'-chlorophenyl)carbamoylmethylene]-3-iminoisoindoline, 1-[cyano-N-(4'-methoxyphenyl)-carbamoylmethylene]-3-iminoisoindoline, 1-[cyano-N-(3'-chloro-4'-methylphenyl)-carbamoylmethylene]-3-iminoisoindoline, 1-(cyano-p-nitrophenylmethylene)-3-iminoisoindoline, 1-(dicyanomethylene)-3-iminoisoindoline, 1-(cyano-1',2',4'-triazolyl-(3')-carbamoylmethylene)-3-iminoisoindoline, 1-(cyanothiazoyl-(2')-carbamoylmethylene)-3-iminoisoindoline, 1-(cyanobenzimidazolyl-(2')-carbamoylmethylene)-3-iminoisoindoline, 1-(cyanobenzothiazoly(2')-carbamoylmethylene)-3-iminoisoindoline, 1-[(cyanobenzimidazolyl-2')-methylene]-3-iminoisoindoline, 1-[(cyanobenzimidazolyl-2')-methylene]-3-imino-4,5,6,7-tetrachloroisoindoline, 1-[cyanobenzimidazolyl-(2')-methylene]-3-imino-3-methoxyisoindoline, 1-[(cyanobenzimidazolyl-2')-methylene]-3-imino-6-chloroisoindoline, 1-[(1'-phenyl-3'-methyl-5-oxo)-pyrazolidene-4']-3-iminoisoindoline, 1-[cyanobenzimidazolyl-2')-methylene]-3-imino-4,7-dithiatetrahydroisoindoline, 1-[(cyanobenzimidazolyl-2')-methylene]-3-imino-5,6-dimethyl-4,7-pyradinoisoindoline, 1-[(1'-methyl-3'-n-butyl)barbituric acid-5'-]-3-iminoisoindoline, 3-imino-1-sulfobenzoic acid imide, 3-imino-1-sulfo-6-chlorobenzoic acid imide, 3-imino-1-sulfo-5,6-dichlorobenzoic acid imide, 3-imino-1-sulfo-4,5,6,7-tetrachlorobenzoic acid imide, 3-imino-1-sulfo-4,5,6,7-tetrabromobenzoic acid imide, 3-imino-1-sulfo-4,5,6,7-tetrafluorobenzoic acid imide, 3-imino-1-sulfo-6-nitrobenzoic acid imide, 3-imino-1-sulfo-6-methoxybenzoic acid imide, 3-imino-1-sulfo-4,5,7-trichloro-6-methylmercaptobenzoic acid imide, 3-imino-1-sulfonaphthoic acid imide, 3-imino-1-sulfo-5-bromonaphthoic acid imide, and 3-imino-2-methyl-4,5,6,7-tetrachloroisoindolin-1-one.

Sensitivity of the heat-sensitive recording material of the present invention can further be enhanced by using a co-dispersion prepared by pulverizing simultaneously imino compound and metallic soap disclosed in Japanese Patent Application No. 63-263747 by the inventors of the present invention.

The metallic soaps are metal salts of fatty acids, resin acids, naphthenic acid, and the like. These acids include, for example, caproic acid, caprylic acid, capric acid, lauric acid, myristic acid, palmitic acid, stearic acid, behenic acid, 12-hydroxystearic acid, ricinoleic acid, linoleic acid, oleic acid, abietic acid, neoabietic acid, d-pimaric acid, benzoic acid, cinnamic acid, p-oxycinnamic acid, and polymethylenecarboxylic acid. The metals include, for example, aluminium, manganese, cobalt, lead, calcium, iron, tin, magnesium, copper, zinc, and nickel.

Preferred are metal salts of aliphatic or alicyclic carboxylic acids e.g. aluminium, zinc, tin, magnesium, or calcium salt and especially preferred are zinc salts.

These metal soaps was used in an amount of 10–300% by weight, preferably 30–200% by weight of the imino compound.

Co-dispersion of imino compound and metallic soap is prepared by previously dispersing them in an aqueous solution containing a compound having dispersibility such as water-soluble polymer, polymeric emulsion or surface active agent and pulverizing the resulting dispersion to average particle size of 5 μm or less, preferably 1.5 μm or less by a dispersing machine such as ball mill, sand mill, dyno mill, attritor or colloid mill.

The heat-sensitive recording material of the present invention may contain a heat meltable material to improve sensitivity. The material is preferably one which has a melting point of 60°–180° C., especially preferably 80°–140° C. As examples thereof, mention may be made of benzyl p-benzyloxybenzoate, stearic acid amide, palmitic acid amide, N-methylolstearic acid amide, β-naphthylbenzyl ether, N-stearylurea, N,N-distearylurea, phenyl β-naphthoate, phenyl 1-hydroxy-2-naphthoate, β-naphthol(p-methylbenzyl)ether, 1,4-dimethoxynaphthalene, 1-methoxy-4-benzyloxynaphthalene, N-stearoylurea, 4-benzylbiphenyl, 1,2-di(m-methylphenoxy)ethane, 1-phenoxy-2-(4-chlorophenoxy)ethane, 1,4-butanediolphenyl ether, and dimethyl terephthalate.

The above heat meltable materials may be used singly or in admixture. In order to obtain sufficient heat responsiveness, it is preferred to use the heat meltable material in an amount of 10–300% by weight, more preferably 20–250% by weight, based on the weight of the aromatic isocyanate compound.

Furthermore, the heat-sensitive recording material of the present invention may contain aniline derivatives having at least one amino group as shown in PCT/JP81/00300 filed by the present inventors and addition of them is further effective for inhibition of fogging in background.

As these compounds, mention may be made of methyl p-aminobenzoate, ethyl p-aminobenzoate, n-propyl p-aminobenzoate, iso-propyl p-aminobenzoate, butyl p-aminobenzoate, dodecyl p-aminobenzoate, benzyl p-aminobenzoate, o-aminobenzophenone, m-aminoacetophenone, p-aminoacetophenone, m-aminobenzamide, o-aminobenzamide, p-aminobenzamide, p-amino-N-methylbenzamide, 3-amino-4-methylbenzamide, 3-amino-4-methoxybenzamide, 3-amino-4-chlorobenzamide, p-(N-phenylcarbamoyl)aniline, p-[N-(4-chlorophenyl)carbamoyl]aniline, p-[N-(4-aminophenyl)carbamoyl]aniline, 2-methoxy-5-(N-phenylcarbamoyl)aniline, 2-methoxy-5-[N-(2'-methyl-3'-chlorophenyl)carbamoyl]aniline, 2-methoxy-5-[N-(2'-chlorophenyl)carbamoyl]aniline, 5-acetylamino-2-methoxyaniline, 4-acetylaminoaniline, 4-(N-methyl-N-acetylamino)aniline, 2,5-diethoxy-4-(N-benzoylamino)aniline, 2,5-dimethoxy-4-(N-benzoylamino)aniline, 2-methoxy-4-(N-benzoylamino)-5-methylaniline, 4-sulfamoylaniline, 3-sulfamoylaniline, 2-(N-ethyl-N-phenylaminosulfonyl)aniline, 4-dimethylaminosulfonylaniline, 4-diethylaminosulfonylaniline, sulfathiazole, 4-aminodiphenylsulfone, 2-chloro-5-N-phenylsulfamoylaniline, 2-methoxy-5-N,N-diethylsulfamoylaniline, 2,5-dimethoxy-4-N-phenylsulfamoylaniline, 2-methoxy-5-benzylsulfonylaniline, 2-phenoxysulfonylaniline, 2-(2'-chlorophenoxy)sulfonylaniline, 3-anilinosulfonyl-4-methylaniline, bis[4-(m-aminophenoxy)phenyl]sulfone, bis[4-(p-aminophenoxy)phenyl]sulfone, bis[3-methyl-4-(p-aminophenoxy)phenyl]sulfone, 3,3'-dimethoxy-4,4'-diaminobiphenyl, 3,3'-dimethyl-4,4'-diaminobiphenyl, 2,2'-dichloro-4,4'-diamino-5,5'-dimethoxybiphenyl, 2,2',5,5'-tetrachloro-4,4'-diaminobiphenyl, o-trizinesulfone, 2,4'-diaminobiphenyl, 2,2'-diaminobiphenyl, 4,4'-diaminobiphenyl, 2,2'-dichloro-4,4'-diaminobiphenyl, 3,3'-dichloro-4,4'-diaminobiphenyl, 2,2'-dimethyl-4,4'-diaminobiphenyl, 4,4'-thiodianiline, 2,2'-dithiodianiline, 4,4'-dithiodianiline, 4,4'-diaminodiphenyl ether, 3,3'-diaminodiphenyl ether, 3,4'-diaminodiphenyl ether, 4,4'-diaminodiphenyl methane, 3,4'-diaminodiphenylmethane, bis(3-amino-4-chlorophenyl)sulfone, bis(3,4-diaminophenyl)sulfone, bis(4-aminophenyl)sulfone, bis(3-aminophenyl)sulfone, 3,4'-diaminodiphenylsulfone, 3,3'-diaminodiphenylmethane, 4,4'-ethylenedianiline, 4,4'-diamino-2,2'-dimethyldibenzyl, 4,4'-diamino-3,3'-dichlorodiphenylmethane, 3,3'-diaminobenzophenone, 4,4'-diaminobenzophenone, 1,4-bis(4-aminophenoxy)benzene, 1,3-bis(4-aminophenoxy)benzene, 1,3-bis(3-aminophenoxy)benzene, 9,9-bis(4-aminophenyl)fluorene, 2,2-bis(4-aminophenoxyphenyl)propane, 4,4'-bis(4-aminophenoxy)diphenyl, 3,3',4,4'-tetraaminodiphenyl ether, 3,3',4,4'-tetraaminodiphenylsulfone, and 3,3',4,4,-tetraaminobenzophenone.

Dispersion of these heat meltable materials and/or aniline derivatives can be prepared by utterly the same process as for preparation of the dispersion of aromatic isocyanate compound and alcoholic compound or imino compound.

The thus obtained dispersion of aromatic isocyanate compound and alcoholic compound, dispersion of imino compound, dispersion of other additives, binder and the like are mixed to prepare a heat-sensitive coating color. This coating color is coated on a support by coating methods such as air knife coating, blade coating and curtain coating to form a heat-sensitive recording layer. Thus, heat-sensitive recording material of the present invention can be obtained.

The heat-sensitive recording material of the present invention comprises a support and, provided thereon, a heat-sensitive recording layer which forms color upon heating. As the support, paper is mainly used, but besides paper, various nonwoven fabrics, synthetic resin films, laminate papers, synthetic papers, metal foils and composite sheets comprising combination of these materials may also be used depending on purposes. The heat-sensitive recording layer may be either of single-layer structure or multi-layer structure. In case of multi-layer structure, intermediate layer may be provided between respective layers. Furthermore, a protective layer may also be provided on this layer. This recording layer can be obtained by coating on support a mixture of respective aqueous dispersion prepared by pulverizing respective color forming components, binder and the like and drying the coat. In this case, each color forming component may be contained in one layer to form a multi-layer structure.

As the binder, mention may be made of water-soluble binders such as starches, hydroxyethyl-cellulose, methylcellulose, carboxymethylcellulose, gelatin, casein, poly(vinyl alcohol), modified poly(vinyl alcohol), styrene-maleic anhydride copolymer, and ethylene-maleic anhydride copolymer; and water-insoluble latex binders such as styrene-butadiene copolymer, acrylonitrile-butadiene copolymer, and methyl acrylate-butadiene copolymer.

The heat-sensitive recording layer may further contain pigments such as diatomaceous earth, talc, kaolin, calcined kaolin, calcium carbonate, magnesium carbonate, titanium oxide, zinc oxide, silicon oxide, aluminium hydroxide, and urea-formaldehyde resin. In order to prevent abrasion of head, sticking and the like, the recording layer may further contain higher fatty acid metal salts such as zinc stearate and calcium stearate; and waxes such as paraffins, paraffin oxide, polyethylene, polyethylene oxide, stearic acid amide, and castor wax. Moreover, the recording layer may still further contain dispersants such as sodium dioctylsulfosuccinate, ultraviolet absorbers of benzophenone type and benzotriazole type, surface active agents and fluorescent dyes.

The present invention will be explained in more detail by the following examples.

EXAMPLE 1

100 g of 4,4',4''-triisocyanate-2,5-dimethoxytriphenylamine and 50 g of ethanol were dispersed together with 400 g of 2.5% aqueous poly(vinyl alcohol) solution in a sand mill.

Separately, 150 g of an imino compound: 1,3-diimino-4,5,6,7-tetrachloroisoindoline and 150 g of a metallic soap: zinc stearate were co-dispersed together with 700 g of 8.5% aqueous poly(vinyl alcohol) solution in a sand mill to obtain a co-dispersion.

Furthermore, similarly, 200 g of 2-benzyloxynaphthalene was dispersed with 800 g of 2.5% aqueous poly(vinyl alcohol) solution to obtain a dispersion.

These three dispersions were mixed with one another and stirred sufficiently and then thereto were added 1,250 g of 40% dispersion of calcium carbonate and 1,500 g of 5% aqueous poly(vinyl alcohol) solution, followed by sufficiently stirring to obtain a coating color.

This heat-sensitive coating color was coated at 5.1 $g/m^2$ (in terms of dry solid content) on a paper of 50 $g/m^2$ in basis weight and dried and then treated by supercalender to obtain a heat-sensitive recording material.

This heat-sensitive recording material was subjected to printing under conditions of applied voltage: 11.00 volt and applied pulse width: 1.4 milliseconds using a heat-sensitive facsimile printing tester and density of the resulting colored image was measured by Macbeth densitometer RD-918 to obtain 1.15, which was sufficient for practical use.

Furthermore, in the same manner as above, a dispersion of 4,4',4''-triisocyanate-2,5-dimethoxytriphenylamine and ethanol was prepared and left to stand at room temperature.

After lapse of 100 days from preparation of the dispersion, this dispersion left at room temperature was mixed with a co-dispersion of 1,3-diimino-4,5,6,7-tetrachloroisoindoline and zinc stearate, a dispersion of 2-benzyloxynaphthalene, a dispersion of calcium carbonate, and an aqueous poly(vinyl alcohol) solution which were freshly prepared in the same manner as above and thus a heat-sensitive coating color was obtained.

A heat-sensitive recording material was prepared using this coating color in the same manner as above and printing was conducted under the same conditions as above.

Density of the resulting color image was measured. As a result, it was found that the heat-sensitive recording material prepared using the dispersion of 4,4',4''-triisocyanate-2,5-dimethoxyphenylamine and ethanol which had been left to stand for 100 days after preparation formed color image of similar density to that obtained on the heat-sensitive recording material prepared using dispersion just after preparation and showed no marked reduction of sensitivity and storage stability of dispersion of aromatic isocyanate compound was good.

EXAMPLE 2

100 g of 4,4',4''-triisocyanate-2,5-dimethoxytriphenylamine and 30 g of ethanol were dispersed in a sand mill together with 400 g of 2.5% aqueous poly(vinyl alcohol) solution.

This dispersion was mixed with a co-dispersion of 1,3-diimino-4,5,6,7-tetrachloroisoindoline and zinc stearate, a dispersion of 2-benzyloxynaphthalene, a dispersion of calcium carbonate and aqueous poly(vinyl alcohol) solution which were prepared in the same manner as in Example 1 to obtain a heat-sensitive coating color.

A heat-sensitive recording material was prepared using this coating color in the same manner as in Example 1 and printing was conducted under the same conditions as in Example 1.

Density of the resulting color image was measured to obtain 1.15, which was a sufficient density for practical use.

Furthermore, in the same manner as in Example 1, color formability of heat-sensitive recording material prepared using a dispersion of 4,4',4''-triisocyanate-2,5-dimethoxytriphenylamine and ethanol which had been left to stand for 100 days after preparation was evaluated to find that the resulting image had a density similar to that obtained on the heat-sensitive recording material made by using the dispersion just after preparation and no conspicuous reduction in sensitivity was recognized and further, storage stability of the dispersion of aromatic isocyanate compound was good.

EXAMPLES 3-10

Heat-sensitive recording materials were prepared in the same manner as in Example 1, except that 10 g of ethanol, 5 g of ethanol, 30 g of glycerin, 10 g of glycerin, 30 g of trimethylolpropane, 10 g of trimethylolpropane, 30 g of pentaerythritol, and 10 g of pentaerythritol were used in place of 50 g of ethanol in Examples 3-10, respectively. Printing was conducted under the same conditions as in Example 1.

Density of color image and storage stability of dispersion of aromatic isocyanate compound after left to stand for 100 days in respective Examples are shown in table. These were all in the level where no practical problems are present.

COMPARATIVE EXAMPLES 1-6

Heat-sensitive recording materials were prepared in the same manner as in Example 1, except that ethanol was omitted, or in place of 50 g of ethanol were used 10 g of triethylenetetramine, 10 g of guanidine carbonate, 10 g of benzoylhydrazine, 10 g of urea, and 10 g of benzenesulfonamide in Comparative Examples 1-6, respectively. Printing was conducted under the same conditions as in Example 1.

Density of images and storage stability of dispersion of aromatic isocyanate compound after left to stand for 100 days in respective Comparative Examples are shown in Table. The results were all practically unsatisfactory.

As explained above, heat-sensitive recording material excellent in image stability and sensitivity which comprises an aromatic isocyanate compound and an imino compound which reacts with the aromatic isocyanate compound upon application of heat to form color can be obtained by using a dispersion prepared by pulverizing simultaneously said aromatic isocyanate compound and an alcoholic compound.

TABLE

| | Additive | Addition amount (g) | Density of image | Storage stability of dispersion |
|---|---|---|---|---|
| Example 1 | Ethanol | 50 | 1.15 | ○ |
| Example 2 | Ethanol | 30 | 1.15 | ○ |
| Example 3 | Ethanol | 10 | 1.11 | ○ |
| Example 4 | Ethanol | 5 | 1.08 | Δ |
| Example 5 | Glycerin | 30 | 1.14 | ○ |
| Example 6 | Glycerin | 10 | 1.13 | ○ |
| Example 7 | Trimethylol-propane | 30 | 1.14 | ○ |
| Example 8 | Trimethylol-propane | 10 | 1.12 | ○ |
| Example 9 | Pentaery-thritol | 30 | 1.13 | ○ |
| Example 10 | Pentaery-thritol | 10 | 1.11 | ○ |
| Comparative Example 1 | No addition | — | 0.91 | x |
| Comparative Example 2 | Triethylene-tetramine | 10 | 0.57 | x |
| Comparative Example 3 | Guanidine carbonate | 10 | 0.92 | x |
| Comparative Example 4 | Benzoyl-hydrazine | 10 | 1.06 | x |
| Comparative Example 5 | Urea | 10 | 0.98 | x |
| Comparative Example 6 | Benzene-sulfonamide | 10 | 0.98 | x |

Storage stability of dispersion:
○: There is utterly no practical problem.
Δ: There is substantially no practical problem.
x: Dispersion cannot be practically used.

What is claimed is:

1. A heat-sensitive recording material comprising an aromatic isocyanate compound, an imino compound which reacts with said aromatic isocyanate compound upon application of heat to form color, and a support, said support having been coated with a dispersion obtained by mixing a) a dispersion of said aromatic isocyanate and an alcoholic compound prepared by simultaneously pulverizing said aromatic isocyanate and said alcoholic compound and b) a dispersion of said imino compound.

2. A heat-sensitive recording material according to claim 1, wherein the alcoholic compound is a mono- or polyhydric, lower or higher aliphatic alcohol, alicyclic alcohol or aromatic alcohol which is liquid at room temperature or has compatibility with water.

3. A heat-sensitive recording material according to claim 1, wherein the aromatic isocyanate compound is 4,4',4''-triisocyanate-2,5-dimethoxytriphenylamine.

4. A heat-sensitive recording material according to claim 1, wherein the imino compound is 1,3-diimino-4,5,6,7-tetrachloroisoindoline.

5. A heat-sensitive recording material according to claim 1, wherein the alcoholic compound is ethanol, glycerin, trimethylolpropane or pentaerythritol.

6. A heat-sensitive recording material according to claim 1, wherein the support is paper, nonwoven fabric, synthetic resin film, laminate paper, synthetic paper, or metal foil.

7. A heat-sensitive recording material which comprises a support and, provided thereon, a heat-sensitive recording layer comprising an aromatic isocyanate compound and an imino compound which reacts with said aromatic isocyanate compound upon application of heat to form color wherein said heat-sensitive recording layer is formed by coating on the support a dispersion obtained by mixing a) a dispersion of said aromatic isocyanate and an alcoholic compound prepared by simultaneously pulverizing said aromatic isocyanate sand said alcoholic compound and b) a dispersion of said imino compound.

* * * * *